US007681261B1

(12) United States Patent
O'Neill

(10) Patent No.: US 7,681,261 B1
(45) Date of Patent: Mar. 23, 2010

(54) SWADDLING BLANKET

(76) Inventor: Victoria H. O'Neill, 15 Frame Ave., Frazer, PA (US) 19355-1520

( * ) Notice: Subject to any disclaimer, the term of this patent is extended or adjusted under 35 U.S.C. 154(b) by 0 days.

(21) Appl. No.: 12/314,503

(22) Filed: Dec. 11, 2008

(51) Int. Cl.
*A41B 13/06* (2006.01)

(52) U.S. Cl. ..... 5/482; 2/69.5

(58) Field of Classification Search ..... 5/482, 5/485, 494, 413 R; D2/719; 2/69, 69.5
See application file for complete search history.

(56) References Cited

U.S. PATENT DOCUMENTS 1,678,125 A 7/1928 Petrescu
2,358,410 A * 9/1944 Matthesius ..... 2/69.5
2,504,761 A * 4/1950 Turco ..... 5/413 R
3,034,132 A 5/1962 Landsberger et al.
5,062,168 A 11/1991 Kocib
5,129,406 A * 7/1992 Magnusen et al. ..... 128/873
D395,188 S 6/1998 Rush
6,640,340 B2 11/2003 Gibson
7,254,849 B1 8/2007 Fiebrich et al.

* cited by examiner

*Primary Examiner*—Alexander Grosz
(74) *Attorney, Agent, or Firm*—Richard C. Litman

(57) ABSTRACT

The swaddling blanket is preferably fabricated from a soft material. The blanket includes a double-layered back portion having a reinforced head area. A pocket member is attached to the front layer of the back portion to accommodate the infant's legs. Double-layered, tapered tie members are attached to the back portion. The tie members are utilized to secure the infant in the blanket.

1 Claim, 3 Drawing Sheets

SWADDLING BLANKET

BACKGROUND OF THE INVENTION

1. Field of the Invention

The present invention generally relates to infant care products. More specifically, the present invention is drawn to a swaddling blanket for an infant.

2. Description of the Related Art

Providing bands of cloth to wrap infants is known as swaddling. Traditionally, this, centuries old, art entails laying an infant onto a blanket fabricated from soft material and wrapping the infant therein by means of a series of blanket folds, wraps and tucks. The traditional swaddle blanket has proven to be less than desired in that it presents a somewhat bulky package and fails to provide adequate head and neck support for the infant. Furthermore, the infant is often able to kick out of the traditional swaddle. The swaddling art would certainly welcome an improved blanket that would alleviate bulk and provide neck and head support.

Thus, a swaddling blanket solving the aforementioned problems is desired.

SUMMARY OF THE INVENTION

The swaddling blanket is fabricated from a soft material. The blanket includes a double-layered back portion having a reinforced head area. A pocket member is attached to the front layer of the back portion to accommodate the infant's legs. Double-layered, tapered tie members are attached to the back portion. The tie members are utilized to secure the infant in the blanket.

Accordingly, the invention presents a swaddling blanket that includes structure to enhance a snug fit and prevents the infant from kicking out of the blanket. Structure is also provided to support the neck and head of an infant. The blanket is fabricated from sturdy material and is easy to use. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
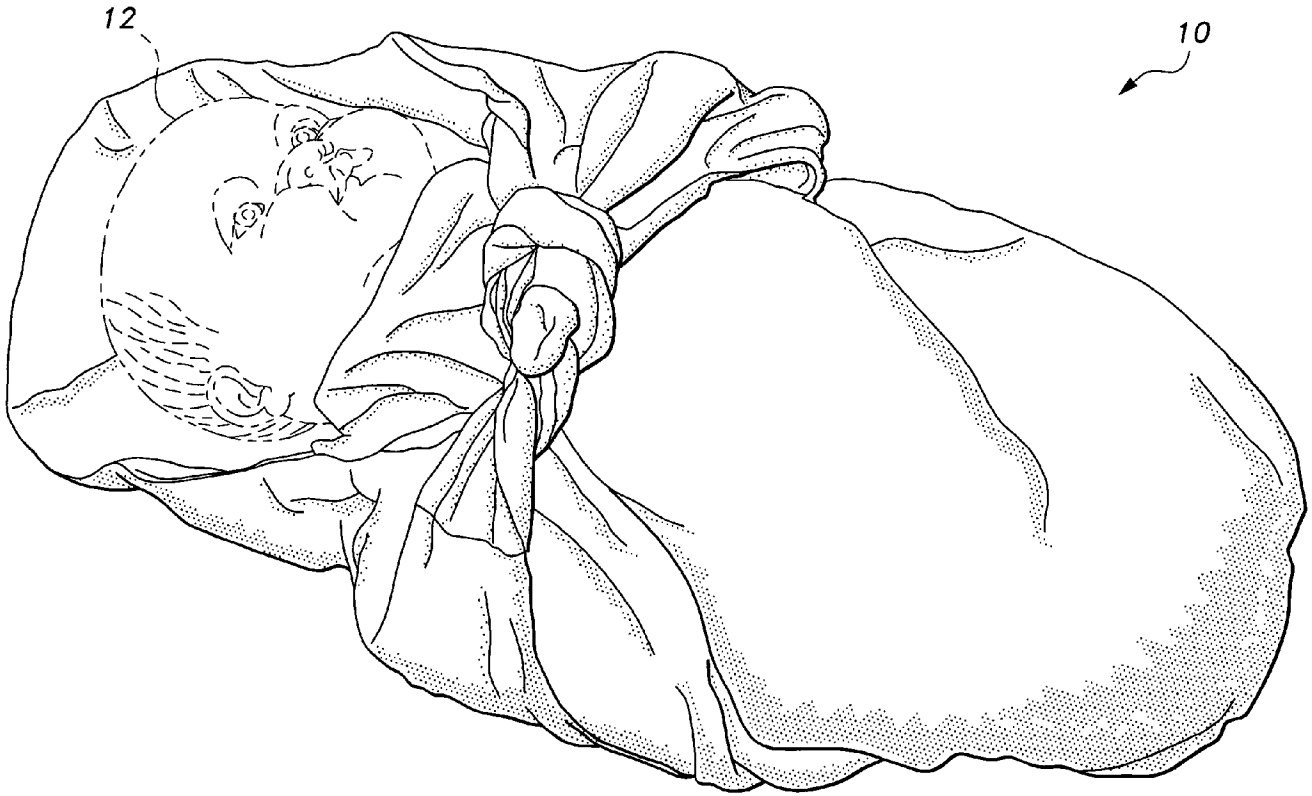
FIG. 1 is an environmental, perspective view of a swaddling blanket according to the present invention.
Figure 2:
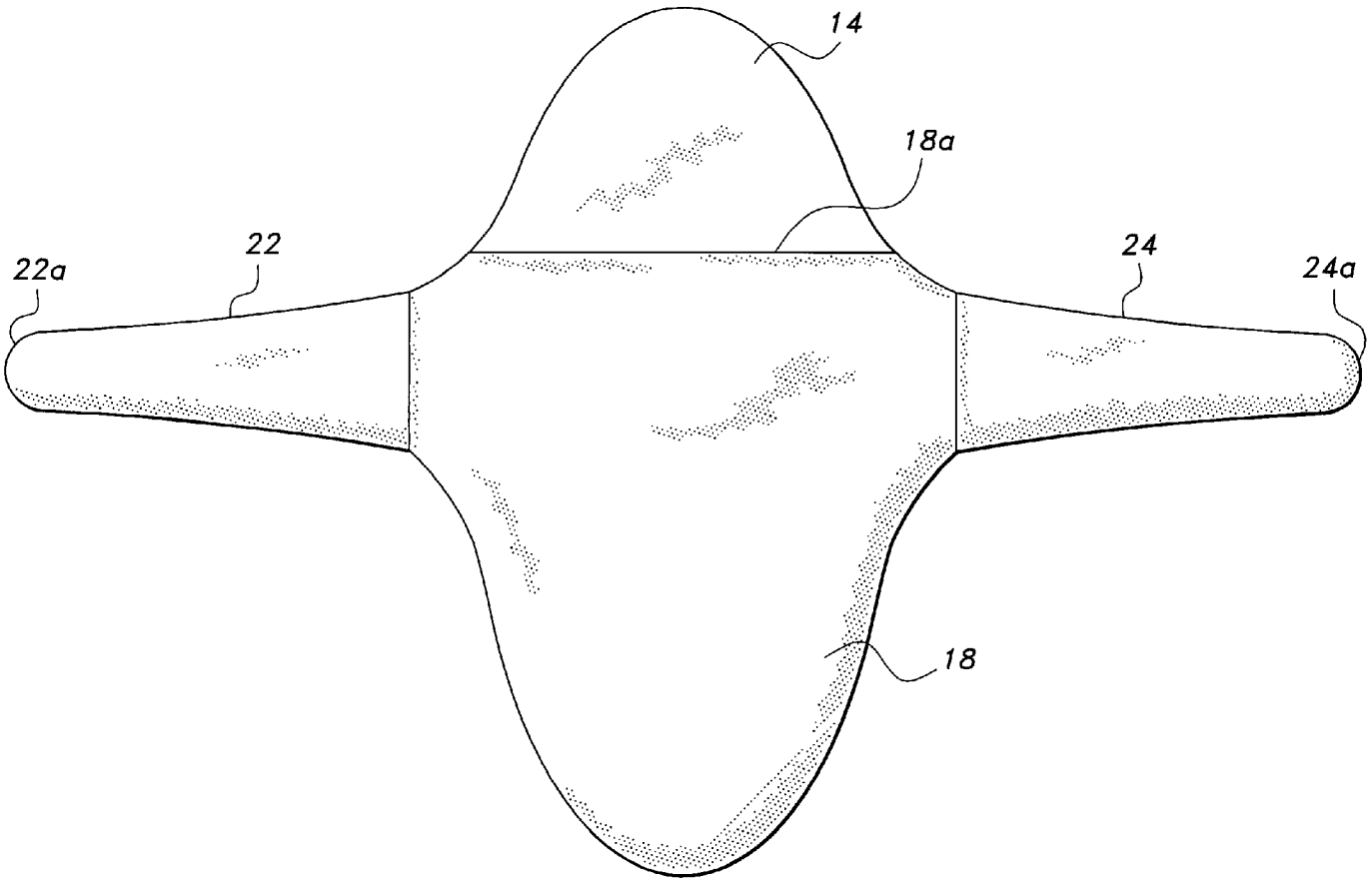
FIG. 2 is a front view of a swaddling blanket according to the present invention.
Figure 3:
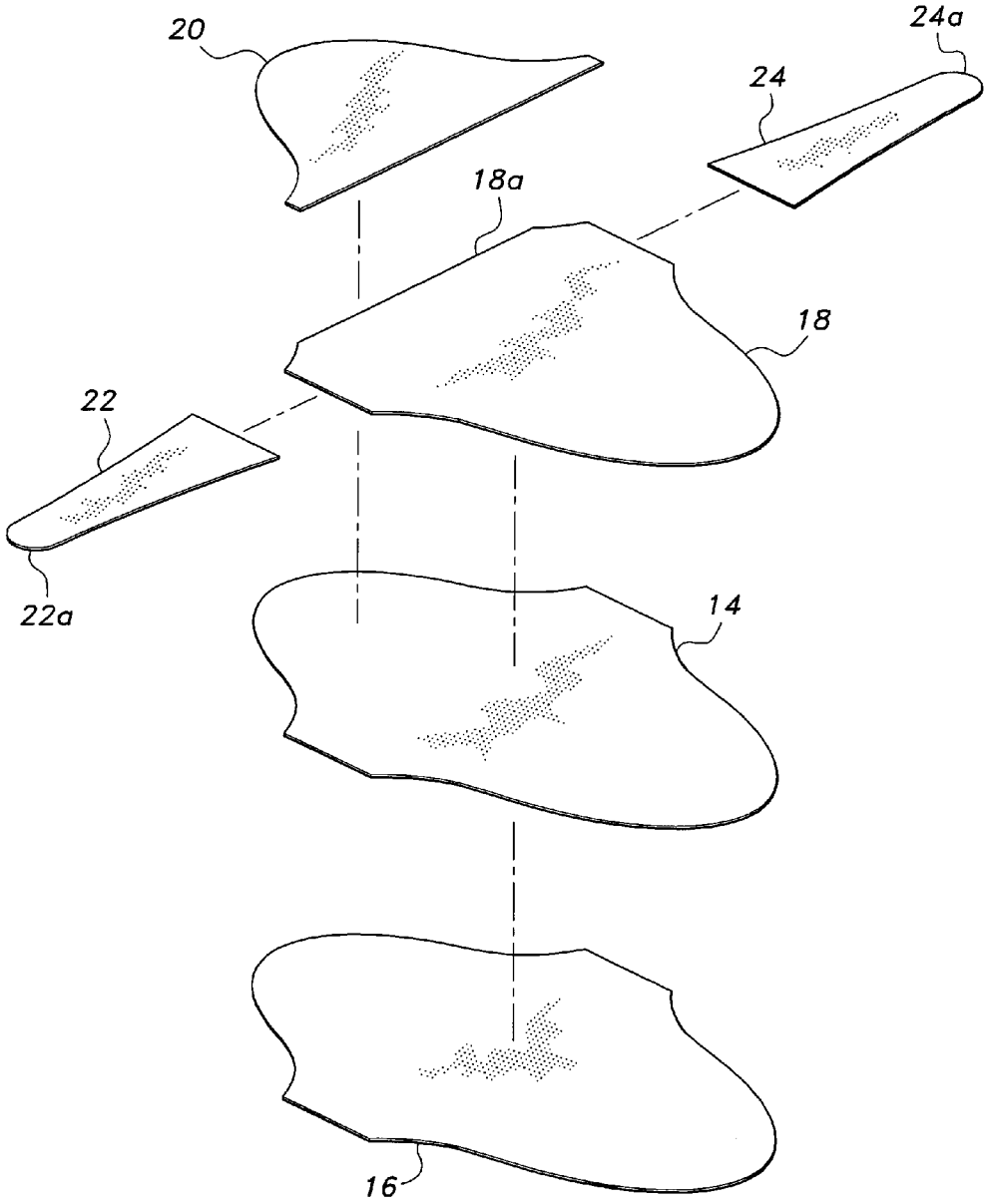
FIG. 3 is an exploded, perspective view of a swaddling blanket according to the present invention.

Attention is directed to FIGS. 1-3 wherein the swaddling blanket is generally indicated at 10 and functions to swaddle an infant 12 therein. Blanket 10 includes a double-layered back portion, which back portion comprises a front layer 14 and a rear layer 16. Layers 14 and 16 are coextensive and are attached together in a suitable manner, i.e. sewing, to form the double-layered back portion. A member 18 is attached to the front layer 14 of the back portion. Member 18 is attached around its edges to the front layer except at its top 18*a* whereas to form a pocket adjacent the front layer 14. A reinforcing member 20 is interfaced between layers 14 and 16, above the top of the pocket, to provide support for the head and the neck of the infant 12. Tie members 22, 24 are attached to the rear portion and extend from opposite edges of the rear portion. Tie members 22, 24 are double-layered for durability and are designed with respective tapered free ends 22*a*, 24*a* to facilitate tying. Because of its sturdiness and shape-holding ability, 100% cotton flannel material is the preferred fabric for the instant blanket. However, It should be recognized that other materials could be utilized if desired.

Using the blanket is easy. One simply places the infant on the blanket and tucks the infant's legs in the pocket. The top edge of the pocket is pulled up adjacent to the infant's neck and the surface of the pocket is smoothed out. The tapered ends of the tie members are then fastened together (preferably in a square knot) to snugly secure the infant in the blanket. As presently contemplated, directions for use will be printed on a label attached to the blanket.

It is to be understood that the present invention is not limited to the embodiment described above, but encompasses any and all embodiments within the scope of the following claims.

I claim:

1. A swaddling blanket fabricated from 100% cotton flannel material, comprising:

a rear layer;

a front layer coextensive with the rear layer and attached to the rear layer to form a double-layered back portion having opposite edges;

a pocket-forming member attached to the front layer, the pocket-forming member having a top edge, a bottom edge and two side edges, wherein said bottom edge and said two side edges are attached to said front layer to form an opening at said top edge;

a reinforcing member interfaced between the rear layer and the front layer, the reinforcing member being positioned above the top edge of the pocket-forming member; and a pair of double-layered tie members, comprised, of a pair single tie members, each tie member respectively attached to the back portion at the respective opposite edges and extending therefrom, said tie members terminating in a free end, the free ends being substantially tapered.

* * * * *